US005942713A

United States Patent [19]

Basak

[11] Patent Number: 5,942,713

[45] Date of Patent: Aug. 24, 1999

[54] HIGH MISSILE PACKING DENSITY LAUNCHING SYSTEM

[75] Inventor: Leszek Stanislaw Basak, Baltimore, Md.

[73] Assignee: Lockheed Martin Corp., Moorestown, N.J.

[21] Appl. No.: 09/020,331

[22] Filed: Feb. 6, 1998

[51] Int. Cl.[6] ..... F41F 3/04

[52] U.S. Cl. ..... 89/1.816; 89/1.812; 89/1.813

[58] Field of Search ..... 89/1.816, 1.817, 89/1.818, 1.819, 1.812, 1.813, 1.814, 1.809, 1.81, 1.8

[56] References Cited

U.S. PATENT DOCUMENTS

| | | | |
|---|---|---|---|
| 3,779,129 | 12/1973 | Lauro | 89/1.814 |
| 3,865,009 | 2/1975 | Kongelbeck | 89/1.815 |
| 4,063,485 | 12/1977 | Carter et al. | 89/1.816 |
| 4,324,168 | 4/1982 | Sano et al. | 89/1.814 |
| 4,433,606 | 2/1984 | Hagelberg et al. | 89/1.817 |
| 4,471,684 | 9/1984 | Johnson et al. | 89/1.817 |
| 4,604,939 | 8/1986 | Hoffmeister et al. | 89/1.816 |
| 5,153,367 | 10/1992 | Markquart et al. | 89/1.816 |
| 5,327,809 | 7/1994 | Matteson et al. | 89/1.817 |

*Primary Examiner*—Harold J. Tudor
*Assistant Examiner*—Theresa M. Wesson
*Attorney, Agent, or Firm*—W. H. Meise; S. D. Weinstein

[57] ABSTRACT

A multiple missile launcher has a plurality of canister holding chambers. Each canister includes a standard connector for connection by a standard cable to a missile launch sequencer. Each canister is loaded with four missiles. The cable has more than enough signal paths to couple launch and safe signals to a single missile, but not sufficient to independently control four missiles. A missile selection signal generator generates selection signals which are sent over a selected one of four separate signal paths of the cable to directly (without intervening active elements) actuate a relay associated with the selected one of the missiles. The four relays are part of a multiplexer which couples the signal set for launch and safe to the selected one of the missiles.

5 Claims, 5 Drawing Sheets

HIGH MISSILE PACKING DENSITY LAUNCHING SYSTEM

FIELD OF THE INVENTION

This invention relates to guided missile launchers, and more particularly to such launchers which include multiple missiles in each launcher position

BACKGROUND OF THE INVENTION

Modern warships use guided missiles as their principal offensive and defensive weapons. Considering that a naval engagement may require the firing of many missiles, a warship must have many missiles available for immediate launch. This need has been met by various multiple-missile launchers, in which individual launch locations are loaded with missiles which may be individually launched. The shipboard environment is always subject to space limitations. As the need for more missile firepower has increased, the packing density of the individual multiple-missile launchers has increased, with more missile launch locations within a given region of the ship. The MK29 is a multiple-missile rail-type launcher which holds about eight Sea Sparrow missiles.

In addition to the need to launch multiple missiles within a short space of time, a need has also developed to launch, from a single missile launcher, missiles of different mission types, as for example antiaircraft missiles and cruise missiles. For example, the below-deck Mk41 launcher accepts canisterized missiles, in which each canister contains a single-mission missile. The canisters are loaded into corresponding canister holding chambers or cells in the Mk41. Each canisterized missile has a standardized connector, which is connected within each cell, by a standardized umbilical cable, to a launch sequencer. The launch sequencer is an electronic assembly which identifies the missile within the canisters to which it is connected, by interrogating the coding of a canister coding plug associated with the canister. The launch sequencer also responds to arming and firing signals from a higher level of control, by producing a sequence of at least firing and safe signals for the identified missile, which firing and safe signals are coupled over the umbilical cable to the container and to the missile within, for controlling its launching.

The multiple-missile launchers must have canister holding cell chambers which are large enough to accommodate the largest missiles among the various missiles which are to be launched. When smaller missiles are to be fired, the smaller missile may not fully occupy the canister in a physical sense, although the canister always fully occupies a canister holding cell. This, in turn, gives rise to the possibility of launching a plurality of small missiles, without reloading, from a single canister holding cell, by loading each canister with plural missiles.

Improved arrangements are desired for holding and launching missiles.

SUMMARY OF THE INVENTION

A launching system according to an aspect of the invention controllably launches individual missiles from a multi-missile canister containing a plurality of missiles. The multi-missile canister is associated with a standardized canister connector adapted for coupling to a standardized interfacing cable. The system also includes launch electronics associated with the launching system, which includes a standardized first connector. The system also includes a canister relay module physically associated with the canister. The canister relay module is coupled for purposes of power and signal paths to a standardized canister connector associated with the canister. A standardized interfacing cable is coupled to the standardized first connector and to the standardized canister connector. The interfacing cable includes a plurality of conductors, which plurality of conductors is more than sufficient in number for controlling the launch of a single missile, but not sufficient in number for independently controlling the launch of the plurality of missiles from the canister. The launch electronics further includes a source of missile launch and safe signals, which produces individual sequences of launch and safe signals for the launch of an individual missile, and also produces, for each individual sequence of launch and safe signals, selection signals representing that one of the plural missiles within the canister to which the sequence of launch and safe signals should be applied. The launch electronics couples each individual sequence of launch and safe signals, and the associated one of the selection signals, to the standardized first connector of the launch electronics, whereby each the individual sequence of launch and safe signals, and the associated one of the selection signals, is coupled over the conductors of the standardized interfacing cable to the standardized canister connector, for reception by the canister relay module. The canister relay module further includes a multiplexing arrangement coupled to receive the individual sequences of launch and safe signals, and also coupled to each of the plurality of missiles within the canister, for controllably coupling each the sequence of launch and safe signals to one, and only one, of the missiles within the canister, under the control of the selection signals. The multiplexing arrangement includes at least one layer of multiplexing which is directly controlled by the selection signals, without intervening active electronic elements. More particularly, the multiplexing arrangement comprises a like plurality of electromechanical relays. Each of the electromechanical relays includes a coil and a set of movable contacts. The coil of each of the electromechanical relays is connected, without intervening active elements, to a conductor of the container connector, for receiving one of the selection signals. The set of contacts of each of the electromechanical relays is coupled to a further arrangement for coupling the individual sequence of launch and safe signals to a particular one of the missiles within the canister, for, in response to the one of the selection signals, operating the associated one of the set of movable contacts, and for thereby coupling the sequence of launch and safe signals to the selected one of the missiles within the canister. The described use of at least one layer of multiplexing which lacks sensitive active elements renders the system insensitive to inadvertent missile launch due to EMP (a high-energy form of electromagnetic radiation), physical or thermal shock, and the like.

According to another aspect of the invention, a multi-missile canister includes a canister casing defining an interior and an exterior, and a plurality of missiles located within the casing, in positions which allow firing of any one of the missiles without affecting any other one of the missiles within the canister. A standardized connector is physically mounted on the canister, for providing a path for signals between the interior and exterior of the canister. The standardized connector includes conductors for receiving sets of launch and safe signals adapted for launch of one of the missiles within the canister, and for also receiving missile selection signals on any one of a second plurality of missile selection conductors, which second plurality is equal to the first plurality. The missile selection signals are for selecting that one of the first plurality of missiles which is to be launched. A multiplexer is physically associated with the canister. The multiplexer includes a third plurality of electromechanical relays, which third plurality is equal to the first plurality. Each of the electromechanical relays of the third plurality includes an actuating coil coupled, without intervening active elements, to an associated one of the second plurality of conductors of the standardized connector, for being directly actuated by a corresponding one of the missile selection signals. In this context, the term "directly" means actuation without the intervention of active electronics. When the coil is so actuated, the relay routes the set of launch and safe signals from conductors of the standardized connector to an associated one of the first plurality of missiles.

DESCRIPTION OF THE INVENTION

Figure 1:
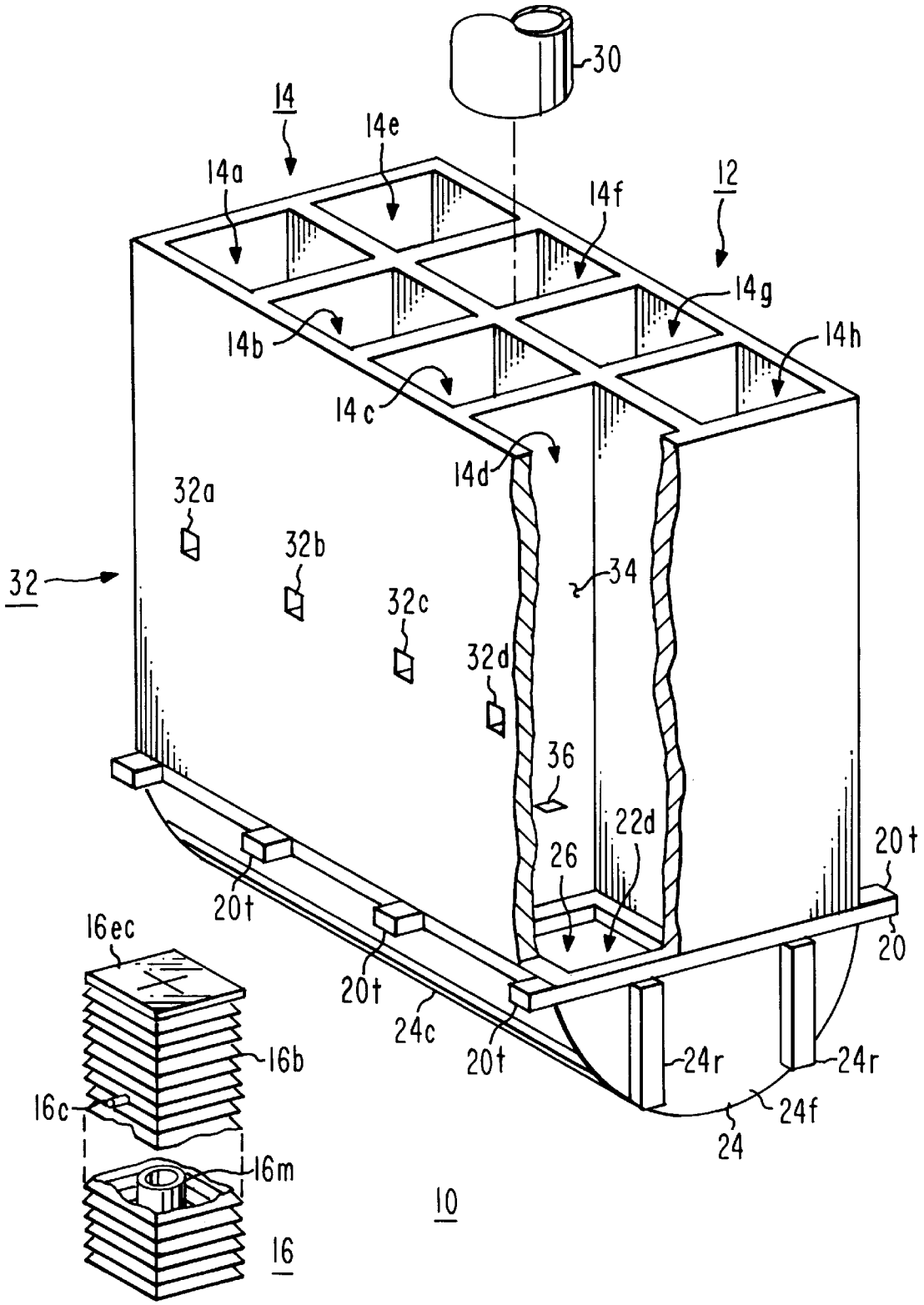
FIG. 1 is a simplified, overall perspective or isometric view of a multiple missile launcher including plural canister holding cells, with the launcher partially sectioned to reveal interior details of one cell, and also illustrating a removable chimney and a similarly dimensioned missile holding canister, either of which can be fitted into any one of the cells of the multiple missile launcher.

FIG. 1 is a simplified, conceptual, perspective or isometric view, partially cut away, of a multiple-missile launcher in accordance with an aspect of the invention. In FIG. 1, the launcher structure itself is designated as 12. The launcher structure 12 is conceptually a framework defining a set 14 of a plurality, illustrated as eight, of canister holding chambers or cells 14*a*, 14*b*, 14*c*, 14*d*, 14*e*, 14*f*, 14*g*, 14*h*. Each canister holding chamber of set 14 has a square cross-section, and is dimensioned to accommodate a single standardized missile canister 16. Missile canister 16 defines a corrugated body 16*b*, and has a fly-through end cover 16*ec*. As illustrated in FIG. 1, the missile 16*m* within the canister 16 has a circular cross-section. Canister 16 also includes a standardized canister connector 16*c*, which is always at the same approximate location on the canister.

In FIG. 1, the array 14 of canister holding cells is mounted on a shield plate 20, which has a plurality of tabs, some of which are designated 20*t*, by which the entire launcher is affixed to its carrier or ship. Shield plate 20 defines an aperture at the lower end of each cell, as suggested by aperture 22*d*, at the bottom of missile-holding cell. A plenum or manifold cover 24 defines one curved side 24*c* which is in the form of half a circular cylinder, for maximum strength. Two flat sides, one of which is designated 24*f*, close off the ends of the plenum. Flat side 24*f* is reinforced with members, two of which are designated 24*r*. The plenum, designated 26, lies between the shield plate 20 and plenum cover 24.

A chimney, the bottom of which is illustrated as 30 in FIG. 1, has outer cross-sectional and length dimensions no greater than those of a canister 16. As illustrated, the chimney 30 is exploded away from missile holding cell 14*f*. When installed, chimney 30 vents missile exhaust gases which enter the plenum during firing of a missile.

The arrangement of FIG. 1 also illustrates a set 32 including a plurality of apertures 32*a*, 32*b*, 32*c*, and 32*d*, which give access through the walls of the multiple missile launcher structure 12 to the corresponding locations of each of cells 14*a*, 14*b*, 14*c*, and 14*d*. A corresponding set of apertures (not visible in FIG. 1) on the opposite side of the multiple missile launcher structure 12 provides access to corresponding locations in cells 14*e*, 14*f*, 14*g*, and 14*h*. The locations of the set of apertures 14 are selected to give access to the standardized canister connector 16*c* of the canister 16 when the canister is properly mounted in the cell. In an actual embodiment of the invention, the walls of multiple missile launcher structure 12 are not solid as illustrated in FIG. 1, but rather are in the form of a truss or lattice, which give access directly to the desired locations, without the need for discrete aperture set 32.

At least one wall of each cell of set 14 of missile holding cells 14 is fitted with one or more dogs, one of which is illustrated as 36 in wall 34 of cell 14*d*. These dogs are dimensioned to fit into a corrugation of the missile holding canister, to aid in preventing longitudinal motion of the canister within the cell.

Figure 2:
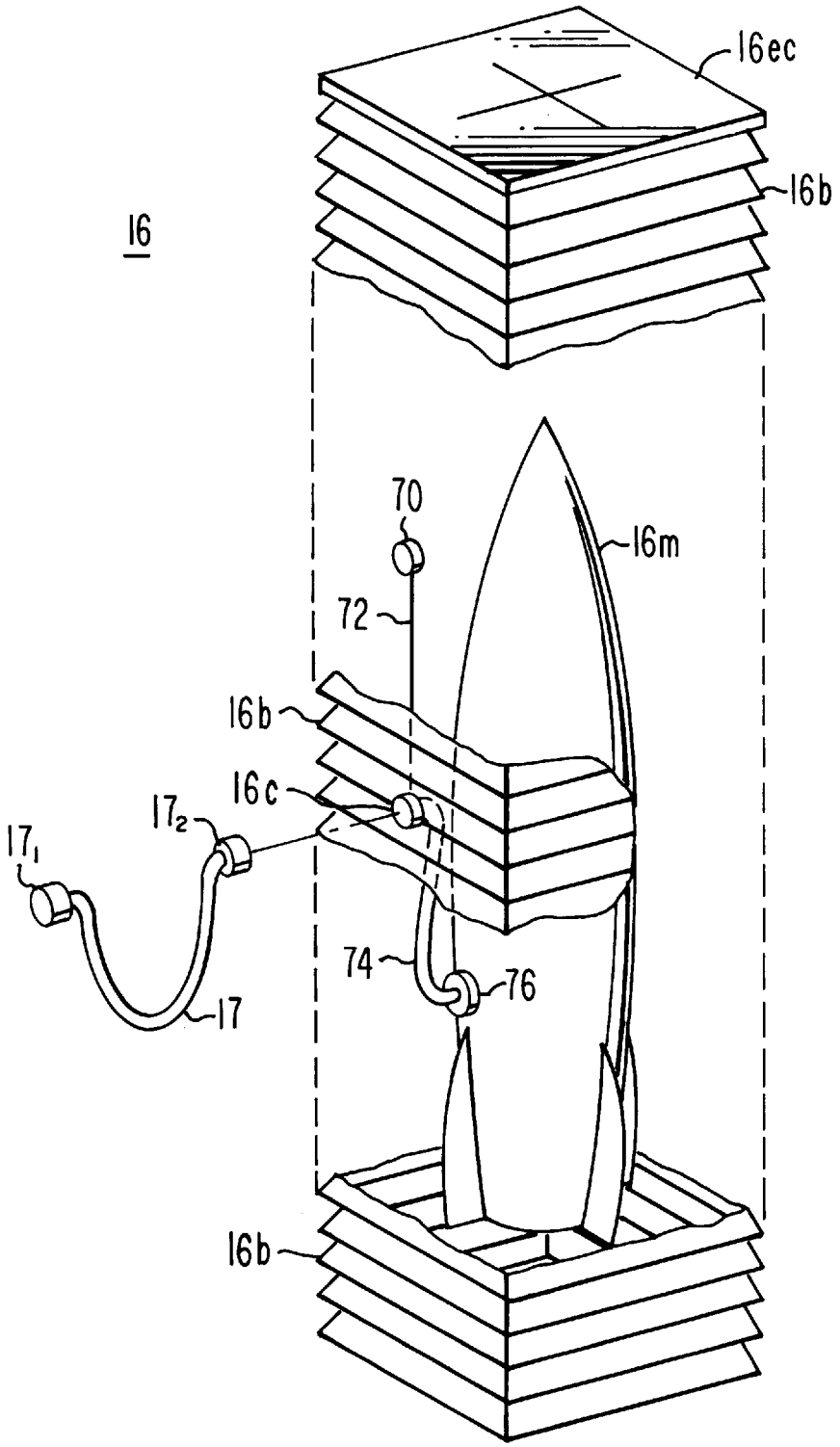
Fig. 2 PRIOR ART
FIG. 2 is a simplified perspective or isometric view of a prior-art single-missile canister, partially cut away to illustrate representative locations of the electrical and signal connections within the canister.

FIG. 2 is a simplified perspective or isometric view, partially cut away to reveal interior details, of a prior-art containerized missile. Elements of canister 16 of FIG. 1 which appear in FIG. 2 are designated by like reference numerals. In FIG. 2, the canister body 16*b* of canister 16 supports a missile 16*m*, As illustrated in FIG. 2, canister container 16 includes a coding plug 70 connected by a plurality of signal paths, illustrated together as 72, to a selected set of the pins (not separately illustrated in FIG. 2) of standardized canister connector 16*c*, for interconnecting various ones of the pins, as known in the art, for providing coding, which can be read through the standardized canister connector 16*c*, which identifies the type of missile 16*m* located within the canister. Others of the pins of standardized canister connector 16*c* are connected by way of an internal power and signal connection path, illustrated as 74, to a missile connector 76, which may be specific to the missile type.

It will be appreciated that, when several different types of missiles are canisterized, and such a variety of missiles, each having a different mission, are to be carried by the warship, the number of different signals and power which must be carried over the umbilical cable 17 may be quite large. For example, when Tomahawk, Vertical-Launch ASROC, Standard Missile blocks 2 and 4, and Sea Sparrow are all to be handled by an umbilical cable 17 having 145 conductors, the addition of a further missile type, having a different mission, to the list of missiles which must be controlled is complicated by the fact that about 126 of the conductors are already utilized, so only about nineteen conductors are available for control of the new type of missile. Even taking into account that many signal and power requirements of such a new missile type may be common with those used by the missiles already controllable by the cell, the remaining number of conductors is fewer than is required for independent control of the new missile type when control is also required for the Tomahawk, Vertical-Launch ASROC, Standard Missile blocks 2 and 4, and Sea Sparrow are all to be handled by an umbilical cable 17. It should be emphasized that, if the launcher is required to handle only one type of missile, whether of a new type or old, the number of conductors in the umbilical cable is sufficient to control launch.

Figure 3:
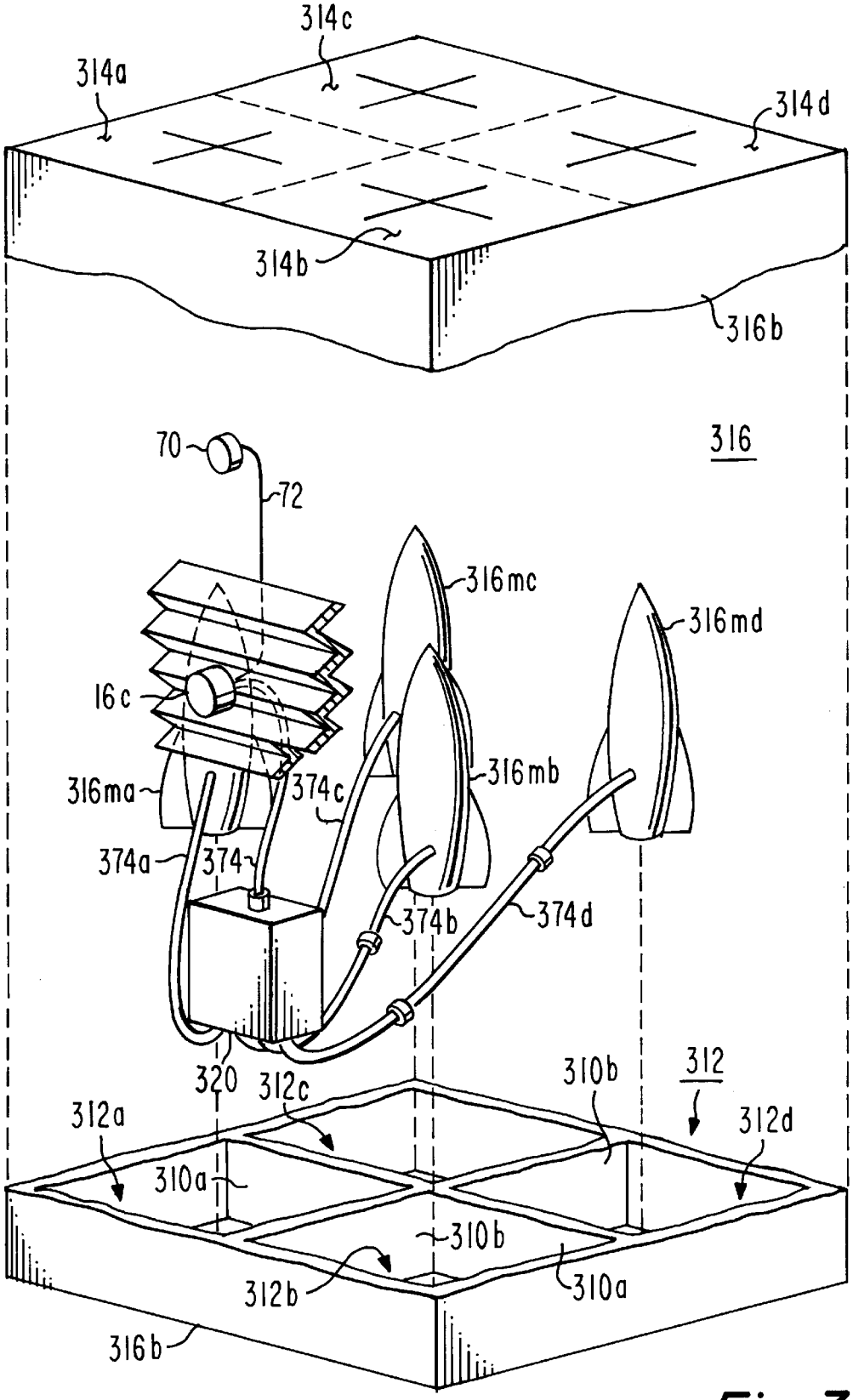
FIG. 3 is a simplified perspective or isometric view of a multiple-missile canister according to an aspect of the invention, partially cut away to illustrate representative connections associated with the canister.

In FIG. 3, a multi-missile canister has a body 316 corresponding to the body 16*b* of canister 16 of FIGS. 1 and 2, having the same exterior dimensions, so that the canister 316 can fit into any one of the cells of set 14 of FIG. 1. In FIG. 3, standardized canister 316 is divided by two intersecting walls, portions of which are illustrated as 310*a* and 310*b*, into a set 312 of four longitudinally-extending sub-cells 312*a*, 312*b*, 312*c*, and 312*d*. Each sub-cell 312*a*, 312*b*, 312*c*, and 312*d* is associated with a corresponding fly-through cover 314*a*, 314*b*, 314*c*, and 314*d*. A separate missile 316*ma*, 316*mb*, 316*mc*, and 316*md* is located within each sub-cell 312*a*, 312*b*, 312*c*, and 312*d*, respectively, of set 312 of missile-holding sub-cells. The four sub-cells are fully isolated from each other to prevent the missile exhaust of one missile from affecting any of the other missiles or the equipment located in another cell.

As in the case of FIG. 2, some conductors or pins, not separately illustrated, of standardized canister connector 16*c* are coupled by multisignal path 72 to a coding plug 70, for identifying the types of missiles in multi-missile canister 316, and also identifying the canister as a multiple-missile canister. In accordance with an aspect of the invention, the arrangement of FIG. 3 includes a multiplexer illustrated as a box or enclosure 320. Enclosure 320 is connected to some of the pins of canister connector 16*c* by way of a multiconductor cable designated 374. Enclosure 320 accepts sets of missile firing signals, and some missile safe signals, arriving from standardized connector 16*c*, and routes the sets of missile firing and safe signals as described below, under the control of missile identification signals, also transmitted to enclosure 320 by way of standardized canister connector 16*c* and multiconductor path 374. According to a salient aspect of the invention, the processing or routing of the missile selection component of the set of incoming signals, to control the routing of the firing and safe signals, is performed without "active" elements. An "active" element, for this purpose, includes solid-state devices (except diodes or rectifiers), tubes, amplifiers, microprocessors, or more generally any component which might be adversely affected by heat, shock, electromagnetic pulse, or the like. Instead, the routing is controlled exclusively by means of electromechanical relays, which are among the hardiest of control elements, and which are reliable under the most adverse conditions. The processing of the firing and safe signals, as described below, allows independent firing of any one of the missiles 316*ma*, 316*mb*, 316*mc*, and 316*md* independently of any other missile in the canister 316.

Figure 4:
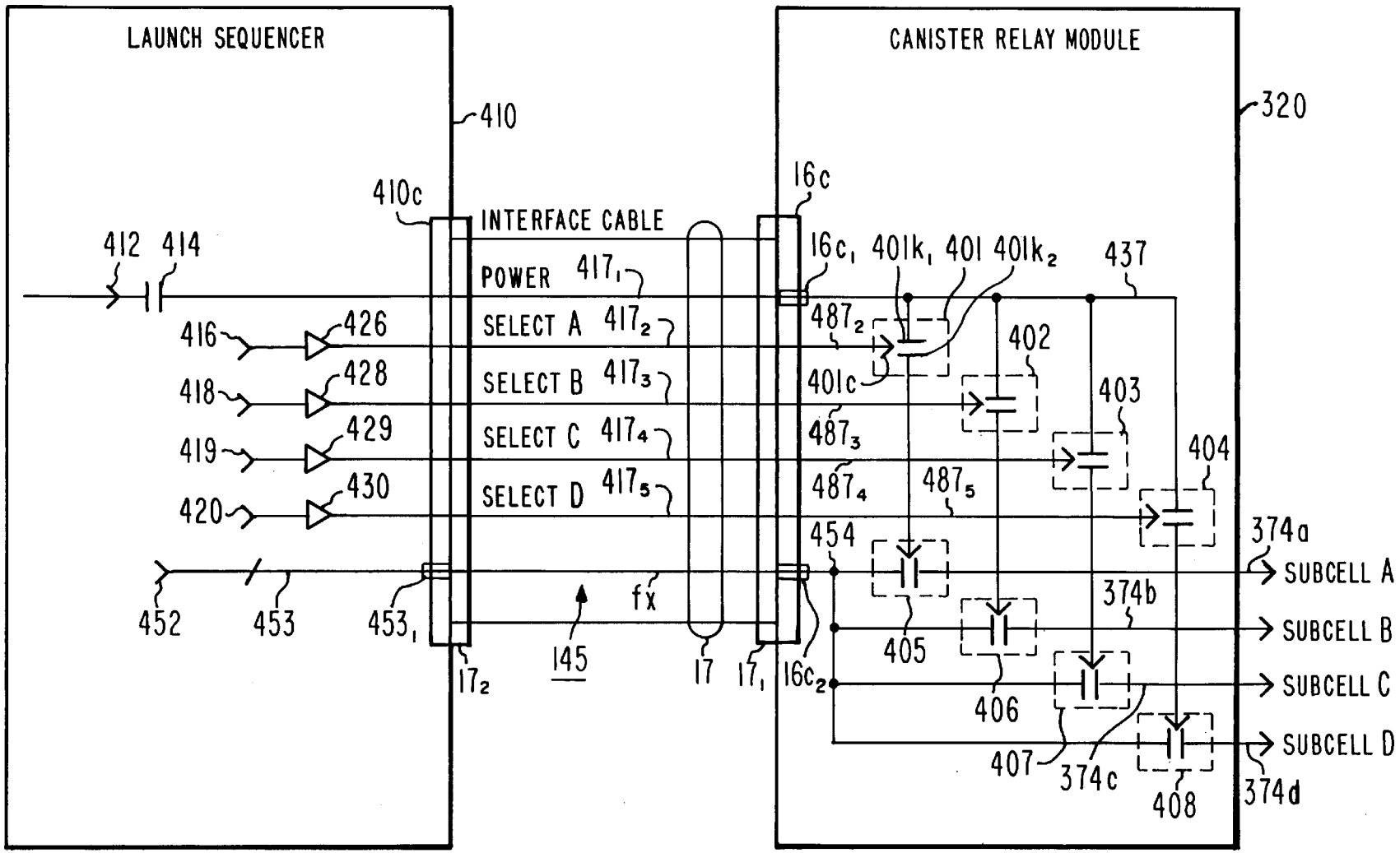
FIG. 4 is a simplified diagram, in block and schematic form, illustrating a portion of a launch sequencer, and some electrical and signal connections within the canister relay module of FIG. 3.

FIG. 4 is a simplified block and schematic diagram of a portion of the launch sequencer electronics 410, umbilical cable 17, and canister relay module 320. In FIG. 4, some of the separate signal and electrical paths are illustrated as originating in the launch sequencer 410. Those skilled in the art realize that the launch sequencer 410 is simply the last stage of a more complex control system, which provides interfaces between the complex control system and the controls within the canister. Ultimate control of the firing of a missile, and selection of the target, lies with human command at a higher level of control, although the control system may be substantially autonomous when activated. Thus, for purposes of this invention, the launch sequencer is the source of signals which command the launch of a missile, and is also the source of electricity for providing the power for activating the missile's engine. A set of terminals 452 is illustrated by a symbol for a single terminal at the left of FIG. 4. This set of terminals receives from a source (not illustrated), on separate conductors, all of the firing and safe signals required to monitor an inactive missile, and to activate a missile. Terminal 452 couples the signals to a set of conductors 453, which are coupled by way of a standardized launch sequencer connector 410*c* to various pins of umbilical cable connector $\mathbf{17}_2$, one of which is illustrated as $\mathbf{453}_1$, to corresponding conductors, designated jointly as $f_x$, of umbilical cable 17. As mentioned, there are insufficient conductors $f_x$ in umbilical cable 17 to independently control the four missiles therein. However, the signals and power on paths $f_x$ are sufficient to fire any one of the four missiles within the canister. The signals and power arriving at standardized canister connector 16*c* from umbilical cable paths $f_x$ are coupled by way of a set of pins, one of which is illustrated as $\mathbf{16}c_2$, and by way of a four-way dividing junction 454, to the set of multiple normally-open (NO) contacts of relays 405, 406, 407, and 408. Each set of contacts of relays 405, 406, 407, and 408 is represented in FIG. 4 by a single contact set. Thus, the contact set of any one of relays 405, 406, 407, and 408 is capable of separately switching or carrying all the signals and power required to fire and monitor the firing of a missile. It should be emphasized that not all of the conductors of umbilical cable 17 are illustrated in FIG. 4, and there are some canister monitoring functions and coding functions which are associated with signal paths in umbilical cable 17, which are not switched by relays 405, 406, 407, and 408. When the set of contacts of any one of relays 405, 406, 407, and 408 are closed, the set of missile control signals on signal paths $f_x$ is applied over one of a further set of signal paths 374*a*, 374*b*, 374*c*, and 374*c*, respectively, to one of the four missiles 316*ma*, 316*mb*, 316*mc*, and 316*md* of FIG. 3. Thus, those of the signals and power needed to fire a missile, and to monitor its firing, are switched or time-division multiplexed among the four missiles by closing the appropriate set of contacts of relays 405, 406, 407, and 408.

In FIG. 4, a terminal 412 receives power, which may be in the form of direct electrical voltage, from a source (not illustrated), and couples the power by way of a relay or contactor 414, which acts as an overall ON-OFF switch, and by way of umbilical connector $\mathbf{17}_1$ to an electrical conductor $\mathbf{417}_1$ of the umbilical. The power on electrical conductor $\mathbf{417}_1$ is coupled by way of connector $\mathbf{17}_2$ and a pin $\mathbf{16}c_1$ to a bus 437 in canister relay module 320. A set of four relays 401, 402, 403, and 404, when in the unactivated state, have open contacts, and prevent the application of control power from bus 437 to the control terminals (the coil terminals, in the preferred embodiment) to any of the four relay sets 405, 406, 407, and 408, each of which, as mentioned above, is illustrated as a single relay for simplicity. Thus, closing of the contacts of any one of relays 401, 402, 403, and 404 results in application of power from bus 434 to the control elements of relay sets 405, 406, 407, and 408, respectively, which in turn energizes that one of the relay sets 405, 406, 407, and 408. According to an aspect of the invention, one of four terminals 416, 418, 419, and 420 of launch sequencer 410 receives a missile selection signal on an exclusive basis, so that signal is applied to only one of terminals 416, 418, 419, and 420. The missile selection signal (Select A; Select B, Select C; Select D) on the active one of terminals 416,

418, 419, and 420 is applied by way of a driver 426, 428, 429, and 430, respectively, to a corresponding selection signal path $\mathbf{417}_2$, $\mathbf{417}_3$, $\mathbf{417}_4$, $\mathbf{417}_5$ of umbilical cable 17. The Select A, Select B, Select C, or Select D signal on the corresponding signal path $\mathbf{417}_2$, $\mathbf{417}_3$, $\mathbf{417}_4$, or $\mathbf{417}_5$, respectively, of umbilical cable 17, is applied to the control terminal of one of relays 401, 402, 403, or 404, respectively, for energizing that selected one of the relays $\mathbf{417}_2$, $\mathbf{417}_3$, $\mathbf{417}_4$, or $\mathbf{417}_5$.

Thus, in operation of the arrangement of FIGS. 3 and 4, power is applied to bus 437 by turning ON relay contact 414, and a missile selection signal is applied to one of missile selection terminals 416, 418, 419, and 420, to close the contacts of the corresponding relay 401, 402, 403, and 404. Closing of the contacts of one of the relays 401, 402, 403, and 404 allows power from the bus 437 to be applied to the control elements of the set of relays associated with one of the relay sets 405, 406, 407, and 408. The application of power to the control elements of one relay set 405, 406, 407, and 408 then routes a sequence of firing and safe signals which may be applied to terminal set 452 to the appropriate one of the missiles within the canister. It will be noted that, in the absence of concurrence of application of power to terminal 412, closure of relay 414, and application of a selection signal to one of terminals 416, 418, 419, and 420, no power can be applied to the control elements of any set of relays 405, 406, 407, and 408, the contacts of those relay sets remain open, and therefore no firing signals can be coupled to any of the missiles. Even if the contacts of sets of relays 405, 406, 407, and 408 should be closed, no missile will be fired unless a set of firing signals is applied to terminal 452. Thus, in order to fire a missile, there must be concurrence of at least two signals arriving at the canister relay module. As mentioned, the canister relay module includes no active elements, but rather contains only relays, for best reliability.

Figure 5:
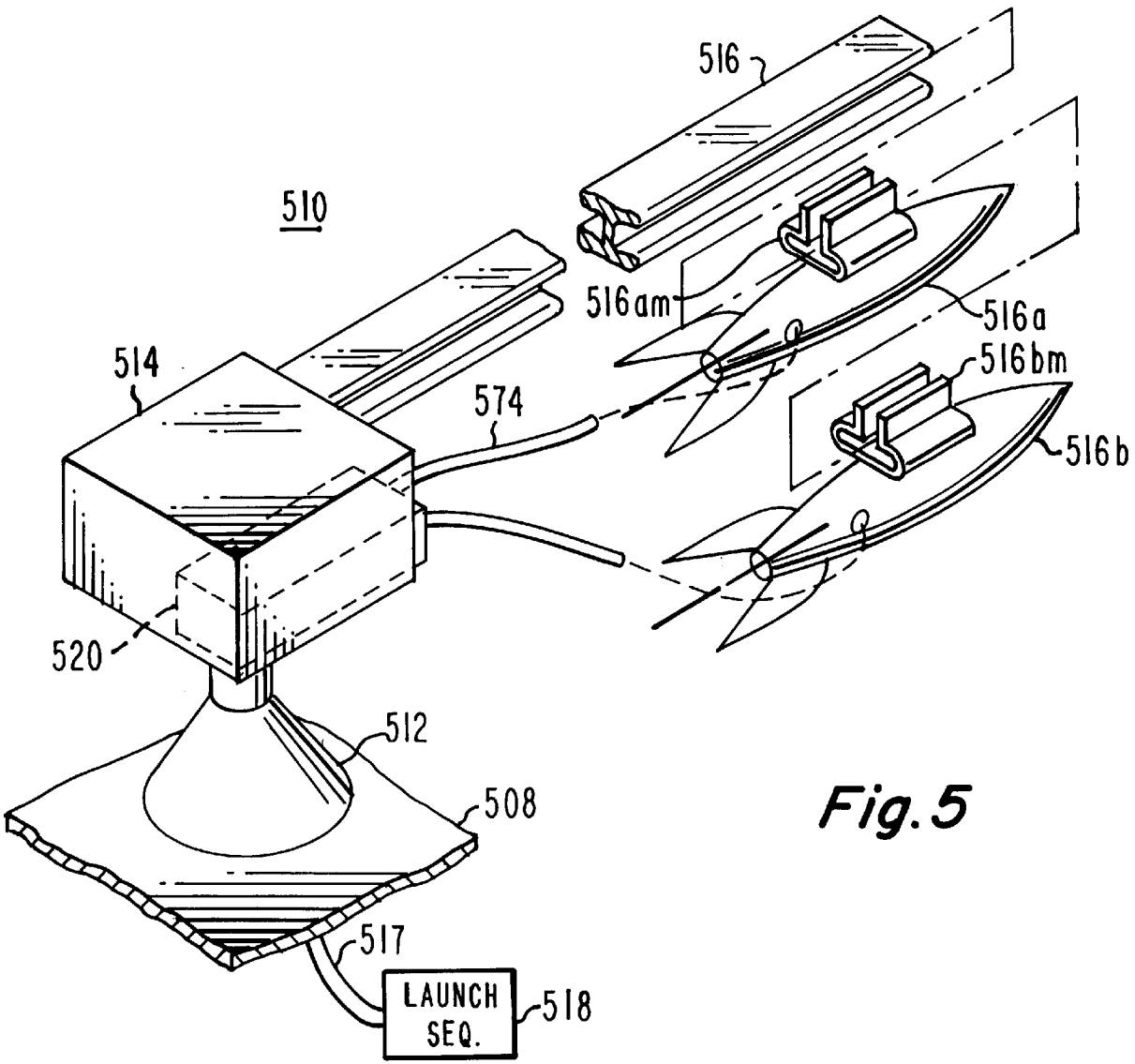
FIG. 5 is a simplified perspective or isometric view, partially exploded and partially cut away, of a rail launcher cell incorporating an aspect of the invention.

FIG. 5 represents a corresponding arrangement for increasing the missile density in a rail-launcher cell 510. In FIG. 5, a rail launcher cell sits on a ship's deck, a portion of which is illustrated as 508. In FIG. 5, the rail launcher cell 510 includes a swivel mount 512 with a structure 514 mounted thereon. Structure 514 holds a rail 516, illustrated as having an I-beam cross-section, cantilevered, with the remote end of the rail free. The rail can be trained in any direction under remote control. The rail-launcher cell 510 is designed to accommodate and launch a single large missile, and for that purpose has a launch sequencer 518 mounted below-decks, which is connected by way of a standardized cable 517 to the above-decks structure 514. Structure 514 would, in the ordinary use of the launcher with a single missile, convey the launch and safe signals to the missile mounted on the rail, by way of a cable such as 574. In accordance with an aspect of the invention, the missile density is increased by using two separate missiles, each of which is smaller than the largest missile which the launcher is designed to accommodate. The two smaller missiles are illustrated as 516*a* and 516*b*. Each of the missiles 516*a* and 516*b* includes a rail mounting arrangement, illustrated as 516*am* and 516*bm*, respectively, which as illustrated are designed to slide onto the lower flange of the rail 516. The two missiles 516*a* and 516*b* are mounted on the rail in tandem, meaning that missile 516*a* is mounted onto the rail first, and placed near structure 514, while missile 516*b* is mounted onto the rail after missile 516*a* is mounted, and is therefore located farther from structure 514. The cable 517 contains more than enough power and signal paths to carry launch and safe signals for any of the missiles for which the rail launcher may be used, but not enough to independently control two missiles. In accordance with the invention, a relay module 520, corresponding in principle to relay module 320 of FIG. 4, is associated with the rail launcher 510 (within structure 514 as illustrated in FIG. 5). The standardized cable 517 is connected to relay module 520, and the two missiles 516*a* and 516*b* are independently controlled in the same manner as described above. Naturally, missile 516*b* must be fired first.

Other embodiments of the invention will be apparent to those skilled in the art. For example, it will be clear that the invention does not depend upon canisterization of the missile, but that the invention may be used with, and applied to, rail-type launchers, so long as the problem exists of insufficient capacity in the interconnections between the control sequencer (or its equivalent) and the plural missiles mounted on each rail to allow individual or independent control of at least some of the missiles on that rail. Similarly, while the invention has been described in the context of a warship, other contexts, such as land installations, mobile armored tanks, aircraft, and the like, will suggest themselves. While the coding plug includes coding relating to the multi-missile nature of the canister with which it is associated, the coding plug may also identify the number of missiles in the container, if desired. While the preferred embodiment of the invention contemplates the use of coil-actuated (current-actuated) relays, piezoelectrically-actuated relays may be usable. While the embodiment of FIG. 5 illustrates tandem missiles on a single rail, much the same kind of increase in missile density can be achieved by paralleling the original rail with a second rail, and mounting the two smaller missiles side-by-side.

Thus, a launching system (10) according to an aspect of the invention controllably launches individual missiles (316*ma*, 316*mb*, 316*mc*, 316*md*) from a multi-missile canister (316) containing a plurality (four in the illustrated embodiment) of missiles. The multi-missile canister (316) is associated with a standardized canister connector (16*c*) adapted for coupling to a standardized interfacing cable (17). The system (10) also includes launch electronics (410) associated with the launching system (10). The launch electronics (410) includes a standardized first connector (410*c*). The system (10) also includes a canister relay module (320) physically associated with the canister (16). The canister relay module (320) includes, or is coupled to, a standardized canister connector (16*c*) associated with the canister (16). A standardized interfacing cable (17) is coupled to the standardized first connector (410*c*) and to the standardized canister connector (16*c*). The interfacing cable (17) includes a plurality (145) of conductors ($\mathbf{417}_1$, $\mathbf{417}_2$, $\mathbf{417}_3$, $\mathbf{417}_4$, $\mathbf{417}_5$, set $f_x$), which plurality of conductors ($\mathbf{417}_1$, $\mathbf{417}_2$, $\mathbf{417}_3$, $\mathbf{417}_4$, $\mathbf{417}_5$, set $f_x$) is more than sufficient in number for controlling the launch of a single missile (16*m*), but not sufficient in number for independently controlling the launch of the plurality (four) of missiles (316*ma*, 316*mb*, 316*mc*, 316*md*) from the canister (316). The launch electronics (410) further includes a source (452) of missile launch and safe signals, which produces individual sequences of launch and safe signals for the launch of an individual missile, and also includes a source (416, 418, 419, 420) which produces, for each of the individual sequences of launch and safe signals, selection signals representing that one of the plural missiles (316*ma*, 316*mb*, 316*mc*, 316*md*) within the canister (316) to which the sequence of launch and safe signals should be applied. The launch electronics (410) couples each individual sequence of launch and safe signals, and the associated one of the selection signals, to the standardized first connector (410*c*) of the launch electronics (410), whereby each the individual sequence of launch and safe signals, and the associated one of the selection signals, is coupled over the conductors (417$_1$, 417$_2$, 417$_3$, 417$_4$, 417$_5$, set $f_x$) of the standardized interfacing cable (17) to the standardized canister connector (16*c*), for reception by the canister relay module (320). The canister relay module (320) further includes a multiplexing arrangement (401, 402, 403, 404, 405, 406, 407, 408 and 454) coupled to receive the individual sequences of launch and safe signals, and also coupled (by way of signal path sets 374*a*, 374*b*, 374*c*, and 374*d*) to each of the plurality (four) of missiles (316*ma*, 316*mb*, 316*mc*, 316*md*) within the canister (316), for controllably coupling each the sequence of launch and safe signals to one, and only one, of the missiles (316*ma*, 316*mb*, 316*mc*, 316*md*) within the canister (316), under the control of the selection signals. The multiplexing arrangement (401, 402, 403, 404, 405, 406, 407, 408 and 454) includes at least one "layer" (relays 401, 402, 403, and 404 or 405, 406, 407, and 408) of multiplexing which is directly controlled by the selection signals, without intervening active electronic elements. More particularly, the multiplexing arrangement (401, 402, 403, 404, 405, 406, 407, 408 and 454) comprises a like plurality (four) of electromechanical relays (401, 402, 403, 404). Each of the electromechanical relays (401, 402, 403, 404) includes a coil (401*c*) and a set of movable contacts (401*k*1, 401*k*2), by which is meant a set of contacts, at least one of which moves in order to make and break the connection. The coil (401*c*) of each of the electromechanical relays (401, 402, 403, and 404) is connected, without intervening active elements, to a conductor (487$_2$, 487$_3$, 487$_4$, 487$_5$, which are connected to umbilical cable conductors 417$_2$, 417$_3$, 417$_4$, 417$_5$, respectively) of the container connector (16*c*), for receiving one of the selection signals. The set of contacts (401*k*1, 401*k*2) of each of the electromechanical relays (401, 402, 403, 404) is coupled to a further arrangement (405, 406, 407, 408, 454) for coupling the individual sequence of launch and safe signals to a particular one of the missiles (316*ma*, 316*mb*, 316*mc*, 316*md*) within the canister (316), for, in response to the one of the selection signals, operating the associated one of the set of movable contacts, and for thereby coupling the sequence of launch and safe signals to the selected one of the missiles within the canister. The described use of at least one layer of multiplexing which lacks sensitive active elements renders the system insensitive to inadvertent missile launch due to EMP (a high-energy form of electromagnetic radiation), physical or thermal shock, and the like.

According to another aspect of the invention, a multi-missile canister (316) includes a canister casing (316*b*) defining an interior and an exterior, and a plurality of missiles (316*ma*, 316*mb*, 316*mc*, 316*md*) located within the casing (316*b*), in positions which allow firing of any one of the missiles (316*ma*, 316*mb*, 316*mc*, 316*md*) without affecting any other one of the missiles within the canister (316). A standardized connector (16*c*) is physically mounted on the canister (316) casing (316*b*), for providing a path for signals between the interior and exterior of the canister. The standardized connector (16*c*) includes conductors (16*c*$_1$, 16*c*$_2$) for receiving sets of launch and safe signals adapted for launch of one of the missiles within the canister, and also for receiving missile selection signals on any one of a second plurality (four) of missile selection conductors (417$_2$, 417$_3$, 417$_4$, 417$_5$) , which second plurality (four) is equal to the first plurality (four). The missile selection signals are for selecting that one of the first plurality (four) of missiles (316*ma*, 316*mb*, 316*mc*, 316*md*) which is to be launched. A multiplexer (401, 402, 403, 404, 405, 406, 407, 408 and 454) is physically associated with the canister (316). The multiplexer (401, 402, 403, 404, 405, 406, 407, 408 and 454) includes a third plurality (four) of electromechanical relays (401, 402, 403, 404), which third plurality (four) is equal to the first (four) plurality. Each of the electromechanical relays (401, 402, 403, 404) of the third plurality (four) of electromechanical relays (401, 402, 403, 404) includes an actuator (401*c*), which may be a coil, coupled, without intervening active elements, to an associated one of the second plurality of conductors (417$_2$, 417$_3$, 417$_4$, 417$_5$) of the standardized connector (16*c*), for being directly actuated by a corresponding one of the missile selection signals. In this context, the term "directly" means actuation without the intervention of active electronics. When the coil is so actuated, the relay routes the set of launch and safe signals from conductors of the standardized connector to an associated one of the first plurality of missiles.

What is claimed is:

1. A launching system for launching individually controllable individual missiles from a missile launcher having a plurality of launch positions, in which each of said launch positions is capable of holding and firing a single missile, said system comprising;

launch position electronics associated with each of said launch positions, said launch position electronics including a source of missile launch and safe signals, which source produces individual sequences of launch and safe signals for the launch of an individual missile from the associated launch position;

launch position physical interface means for physically coupling a plurality of missiles to one of said launch positions;

launch position standardized coupling means coupled to said launch position electronics, said standardized coupling means including a plurality of signal paths including electrical conductors, said plurality of signal paths being more than sufficient in number for controlling the launch of said single missile, but not sufficient in number for independently controlling the launch of a plurality of missiles from one of said launch positions;

said launch position electronics further including selection means which, for each said individual sequence of launch and safe signals, produces selection signals representing that one of said plurality of missiles associated with said launch position to which said sequence of launch and safe signals are applied, said launch electronics coupling each said individual sequence of launch and safe signals, and the associated one of said selection signals, by way of said standardized coupling means to said launch positions; and a relay module associated with said launch positions, said relay module receiving said individual sequence of launch and safe signals, and the associated one of said selection signals, said relay module further including multiplexing means coupled to receive said individual sequences of launch and safe signals, and coupled to each of said plurality of missiles associated with said launch position, for controllably coupling each said sequence of launch and safe signals to one of said missiles associated with said launch positions under the control of said selection signals, said multiplexing means including at least one level of multiplexing which is directly controlled by said selection signals without intervening active electronic elements.

2. A launching system for controllably launching individual missiles from a multi-missile canister containing a plurality of missiles, said canister also being associated with a canister connector adapted for being coupled to a standardized interfacing cable, said system comprising;

launch electronics associated with said launching system, said launch electronics including a standardized first connector;

a canister relay module physically associated with said canister, said canister relay module being associated with a standardized canister connector associated with said canister;

a standardized interfacing cable coupled to said standardized first connector and to said standardized canister connector, said standardized interfacing cable including a plurality of conductors, said plurality of conductors being more than sufficient in number for controlling the launch of a single missile, but not sufficient in number for independently controlling the launch of said plurality of missiles from said canister;

said launch electronics further including a source of missile launch and safe signals, which source produces individual sequences of launch and safe signals for the launch of an individual missile, and, for each said individual sequences of launch and safe signals, also producing selection signals representing that one of said plurality of missiles within said canister to which said sequences of launch and safe signals should be applied, said launch electronics coupling each said individual sequence of launch and safe signals, and the associated one of said selection signals, to said standardized first connector, whereby each said individual sequences of launch and safe signals, and the associated one of said selection signals, is coupled over said conductors of said standardized interfacing cable to said standardized canister connector for reception by said canister relay module; and said canister relay module further including multiplexing means coupled to receive said individual sequences of launch and safe signals, and coupled to each of said plurality of missiles within said canister, for controllably coupling each said sequences of launch and safe signals to one of said missiles within said canister under the control of said selection signals, said multiplexing means including at least one layer of multiplexing which is directly controlled by said selection signals without intervening active electronic elements.

3. A system according to claim 2, wherein said multiplexing means comprises a plurality of electromechanical relays, each of said electromechanical relays including a coil and a set of movable contacts, said coil of each of said electromechanical relays being connected, without intervening active elements, to a conductor of said canister connector, for receiving one of said selection signals, and said set of contacts of each of said electromechanical relays being coupled to further means for coupling said individual sequences of launch and safe signals to a particular one of said missiles within said canister, for, in response to said one of said selection signals, operating the associated one of said set of movable contacts, for thereby coupling said sequences of launch and safe signals to a selected one of said missiles within said canister.

4. A multi-missile canister, comprising:

a canister casing defining an interior and an exterior;

a first plurality of missiles located within said casing, in positions which allow firing of any one of the missiles without affecting any other one of said missiles within said canister;

a standardized connector physically mounted on said canister, for providing a path for signals between the interior and exterior of said canister, said standardized connector being associated with conductors for receiving sets of launch and safe signals adapted for launch of one of said missiles within said canister, and for also receiving missile selection signals on any one of a second plurality of missile selection conductors, which second plurality is equal to said first plurality, for selecting that one of said first plurality of missiles which is to be launched;

a multiplexer physically associated with said canister, said multiplexer including a third plurality of electromechanical relays, which third plurality is equal to said first plurality, each of said electromechanical relays of said third plurality including an actuating coil coupled, without intervening active elements, to an associated one of said second plurality of conductors of said standardized connector, for being directly actuated by a corresponding one of said missile selection signals, and for, when so actuated, routing said set of launch and safe signals from conductors of said standardized connector to an associated one of said first plurality of missiles.

5. A launching system for launching individually controllable individual missiles from a missile launcher having a plurality of launch positions, in which each of said launch positions is capable of holding and firing any one of a plurality of different missiles having different dimensions, said system comprising;

launch position electronics associated with each of said missile launch positions, said launch position electronics including a source of missile launch and safe signals, which source produces individual sequences of launch and safe signals for the launch of an individual missile;

launch position physical interface means for physically coupling a plurality of missiles to at least one of said launch positions;

launch position standardized coupling means coupled to said launch position electronics, said standardized coupling means including a plurality of signal paths including electrical conductors, said plurality of signal paths being more than sufficient in number for controlling the launch of any one of a plurality of single different missiles, but not sufficient in number for independently controlling the launch of a plurality of missiles from said launch positions;

said launch electronics further including selection means which, for each said individual sequences of launch and safe signals, produces selection signals representing that one of said plurality of missiles associated with said launch positions to which said sequences of launch and safe signals are applied, said launch electronics coupling each of said individual sequences of launch and safe signals, and the associated one of said selection signals, by way of said standardized coupling means to said launch positions; and a relay module associated with said launch positions, said relay module receiving said individual sequences of launch and safe signals, and the associated one of said selection signals, said relay module further including multiplexing means coupled to receive said individual sequences of launch and safe signals, and coupled to each of said plurality of missiles associated with said launch positions, for controllably coupling each said sequences of launch and safe signals to one of said missiles associated with said launch positions under the control of said selection signals, said multiplexing means including at least one level of multiplexing which is directly controlled by said selection signals without intervening active electronic elements.

* * * * *